US009079414B2

(12) United States Patent
Lester et al.

(10) Patent No.: US 9,079,414 B2
(45) Date of Patent: Jul. 14, 2015

(54) INKJET PRINTERS

(75) Inventors: Andrew Robert Lester, Cambridge (GB); Adeyinka Opaleye, Cambridge (GB); Matthew Henry Freeman, Cambridge (GB)

(73) Assignee: Domino Printing Sciences PLC (GB)

( * ) Notice: Subject to any disclaimer, the term of this patent is extended or adjusted under 35 U.S.C. 154(b) by 0 days.

(21) Appl. No.: 13/988,212

(22) PCT Filed: Nov. 21, 2011

(86) PCT No.: PCT/GB2011/052277

§ 371 (c)(1), (2), (4) Date: Jul. 12, 2013

(87) PCT Pub. No.: WO2012/066358

PCT Pub. Date: May 24, 2012

(65) Prior Publication Data

US 2013/0293624 A1 Nov. 7, 2013

(30) Foreign Application Priority Data

Nov. 19, 2010 (GB) ..... 1019683.0

(51) Int. Cl.
*B41J 2/195* (2006.01)
*B41J 2/175* (2006.01)

(52) U.S. Cl.
CPC ..... *B41J 2/17566* (2013.01); *B41J 2/17513* (2013.01); *B41J 2/17553* (2013.01)

(58) Field of Classification Search
CPC ..... B41J 2/17566
See application file for complete search history.

(56) References Cited

U.S. PATENT DOCUMENTS

| | | | | |
|---|---|---|---|---|
| 3,777,257 | A * | 12/1973 | Geisselmann | 324/663 |
| 4,007,636 | A * | 2/1977 | Wahl | 73/290 R |
| 5,315,872 | A * | 5/1994 | Moser | 73/304 C |
| 5,754,207 | A | 5/1998 | Gragg et al. | |
| 6,292,104 | B1 * | 9/2001 | Wakabayashi | 340/612 |
| 6,337,959 | B1 * | 1/2002 | Kwak et al. | 399/57 |
| 6,761,067 | B1 * | 7/2004 | Capano | 73/304 C |
| 2001/0037680 | A1 * | 11/2001 | Buck et al. | 73/304 C |
| 2004/0011128 | A1 * | 1/2004 | Gundlach et al. | 73/304 C |
| 2004/0070408 | A1 * | 4/2004 | Florin et al. | 324/662 |
| 2009/0040262 | A1 * | 2/2009 | Watanabe | 347/19 |
| 2009/0158841 | A1 * | 6/2009 | Winkens | 73/304 C |

FOREIGN PATENT DOCUMENTS

| | | |
|---|---|---|
| CN | 201225918 | 4/2009 |
| CN | 101430218 | 5/2009 |
| CN | 201311315 | 9/2009 |
| EP | 1097814 | 5/2001 |
| EP | 1157843 | 11/2001 |
| EP | 1691177 | 8/2006 |
| EP | 2110248 | 10/2009 |
| EP | 2233298 | 9/2010 |
| JP | 63147150 | 6/1988 |

* cited by examiner

*Primary Examiner* — Shelby Fidler
(74) *Attorney, Agent, or Firm* — Price Heneveld LLP

(57) ABSTRACT

The invention provides a method and system for determining fluid levels in an inkjet printer. A non-contact sensor array is provided external to the container in which the levels are to be determined and each sensor in the array is sequentially switched into a sensing circuit until a change in capacitance is noted. The sensing circuit is preferably a frequency oscillation circuit whose frequency is defined by circuit capacitance.

8 Claims, 2 Drawing Sheets

INKJET PRINTERS

FIELD OF THE INVENTION

This invention generally relates to inkjet printing systems, and more particularly to a method of and/or means for determining the level of printing ink and make-up solvent contained, respectively, in an ink service module and a make-up service module of a continuous inkjet printer.

BACKGROUND TO THE INVENTION

In a continuous inkjet printer the ink service module contains a working volume of printing ink and the make-up service module contains a volume of solvent make-up fluid. Make-up fluid is used to control the viscosity of the ink when the printer is in use, and to flush the print head, on start-up and shut-down, to ensure that the print head is clean.

Ink and solvent make-up are typically supplied to inkjet printing systems through the use of disposable bottles. An ink bottle may be mounted on an ink service module or reservoir so that ink can pass from the ink bottle into the ink reservoir. Each ink bottle, when full, contains a finite amount of ink, typically a pint or liter of ink. As the inkjet printing system is continually used, the ink within the ink bottle is depleted. When the ink bottle is fully depleted, a new ink bottle is mounted in place of the depleted ink bottle.

Hence the level of ink in the reservoir is maintained at a particular level.

The same applies with the solvent make-up bottle which is mounted on the make-up service module.

If the volumes of fluid in the ink service module or make-up service module are allowed to deplete there comes a point when the printer performance depreciates and, in some circumstances, the printer can be damaged. Therefore there is a need for fluid levels to monitored and action initiated in the following circumstances:

1. If the ink level is too high ('High'), then an alert should be generated and the printer shut down to prevent ink overflow
2. As the ink level falls, an alert should be generated prompting the operator to replace the cartridge ('Add Cartridge').
3. If the level falls further to a predetermined minimum level ('Low') the printer should be shut down to prevent air ingress and motor damage.
4. It is also desirable to have an indication that the fluid level is in the normal operating range ('OK') i.e. neither too high nor at the point which the cartridge needs to be replaced.

The existing continuous inkjet printer made by the applicant company includes an ink reservoir which is an open topped vessel on to which a manifold is fitted. The manifold is hydraulically connected to an ink management (distribution) block by flexible tubing. The manifold has an ink pick up tube and a level sensing arrangement that is immersed in the ink. The level sensing arrangement is connected to the control system. When the reservoir is changed the manifold is removed from old reservoir and fitted in to the new one. During this operation ink can drip from the level sensor into the printer.

This can cause a mess and, depending on the nature of the ink, cause damage to the printer or its surroundings.

Capacitive level measurement is a technology that offers non-contact level measurement but problems arise when applying such technology to the measurement of ink levels in a continuous inkjet printer. Capacitive level measurement involves measuring the difference in dielectric constant between a fluid, such as ink or solvent make-up, and the environment above the fluid, typically air. One particular problem which arises when applying this technology to continuous inkjet printers is that these printers must operate using a variety of inks and the dielectric constants of these inks can vary significantly. This presents a drawback to an overriding requirement that ink type be changeable with minimal adjustment to the printer.

It is an object of this invention to provide a continuous inkjet printer, and/or one or more components therefor, and/or a method of monitoring fluid levels in a continuous inkjet printer which will go at least some way in addressing aforementioned problems; or which will at least provide a novel and useful choice.

SUMMARY OF THE INVENTION

In one aspect the invention provides a method of determining if a fluid is above or below defined levels in a fluids container for an inkjet printer, said invention including the steps of arranging a substantially vertical array of sensors adjacent an exterior surface of said container; arranging an earth plate beneath said container; and sequentially switching individual sensors into a sensing circuit to determine solely whether the sensor is above or below a fluid level within said container.

Preferably said method involves sequentially switching said sensors from the lowermost sensor upwardly.

Preferably said method comprises shielding said sensors to ensure field lines extending from all of said sensors are directed toward said container.

Preferably said method comprises mounting said sensors on a common carrier.

Preferably said method comprises mounting said carrier so that said sensors can assume positions which are substantially equi-spaced from said exterior surface of said container.

Preferably said method comprises configuring said sensing circuit as a frequency oscillation circuit wherein the frequency of oscillation is defined by circuit capacitance and wherein a change of frequency above a pre-determined threshold between two successive measurements is interpreted as indicating a change from fluid to air between the levels of the sensors giving rise to said successive measurements.

In a second aspect the invention provides an inkjet printer having a fluids container and a level measurement facility external to said container for determining fluid levels within said container, said printer being characterised in that said level measurement facility includes a vertical array of discrete sensors adjacent to an exterior surface of said container; an earth plate beneath said container; and a sensing circuit into which each of said sensors may be sequentially switched to determine solely whether a sensor is above or below a particular fluid level in said container.

Preferably said level measurement facility further includes a carrier on which said array of sensors is mounted, said carrier being configured to ensure field lines from said sensors are directed into said fluids container.

Preferably said carrier has a compliant mount to enable said sensors to assume positions that are substantially equidistant from an exterior wall of said fluids container.

Preferably said sensing circuit is configured as a frequency oscillation circuit wherein the frequency of oscillation is defined by circuit capacitance.

Many variations in the way the present invention can be performed will present themselves to those skilled in the art. The description which follows is intended as an illustration only of one means of performing the invention and the lack of description of variants or equivalents should not be regarded as limiting. Wherever possible a description of a specific element should be deemed to include any and all equivalents thereof whether in existence now or in the future.

BRIEF DESCRIPTION OF THE DRAWINGS

The various aspects of the invention will now be described with reference to the accompanying drawings in which.

DETAILED DESCRIPTION OF WORKING EMBODIMENT

Figure 1:
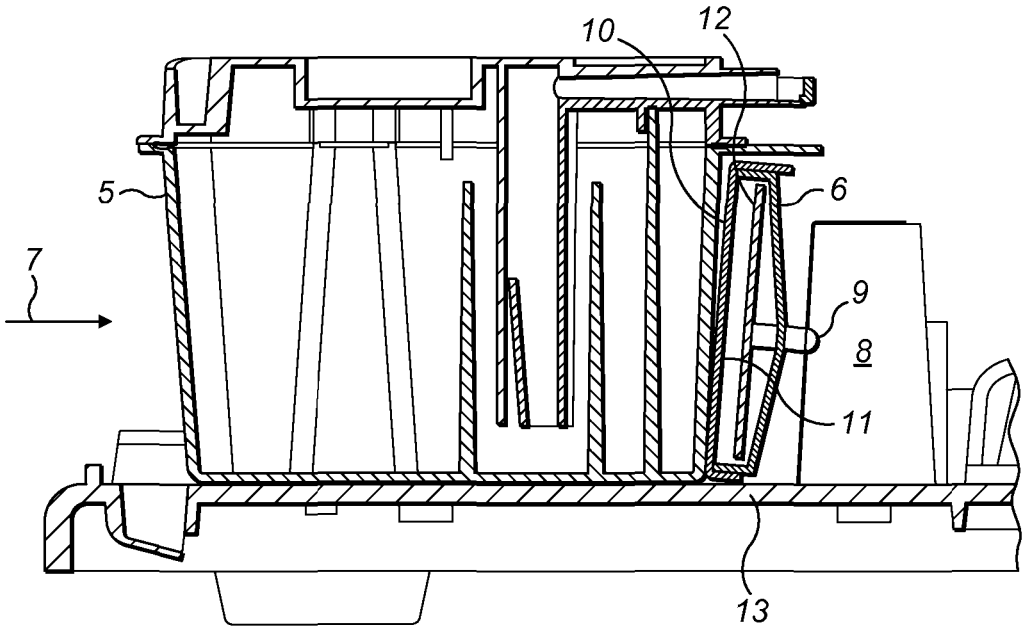
FIG. 1: shows a part-sectional elevational view of a fluids module and level measurement installation according to the invention.

Referring firstly to FIG. 1 the invention provides a method of and a system for determining particular fluid levels in a fluid reservoir of an inkjet printer. As depicted the system is applied to determining levels in an ink service module 5 but the method and apparatus described could equally be applied to determining levels in a solvent make-up reservoir as well as in ink and make-up cartridges.

An important feature of the invention is that the level determining components are not in contact with the fluids and that, preferably, the various fluid bearing containers within the printer can be removed and replaced without displacement or adjustment of the level determining components. Thus, as shown, a carrier 6 is provided against which the module 5 is displaced when inserted into the printer in the direction of arrow 7. The carrier 6 is preferably mounted to the chassis 8 of the printer on a spring-biased compliant swivel mount 9 which allows the front face 10 of the carrier to assume the angle of the wall 11 of the module with which it is in contact.

Figure 2:
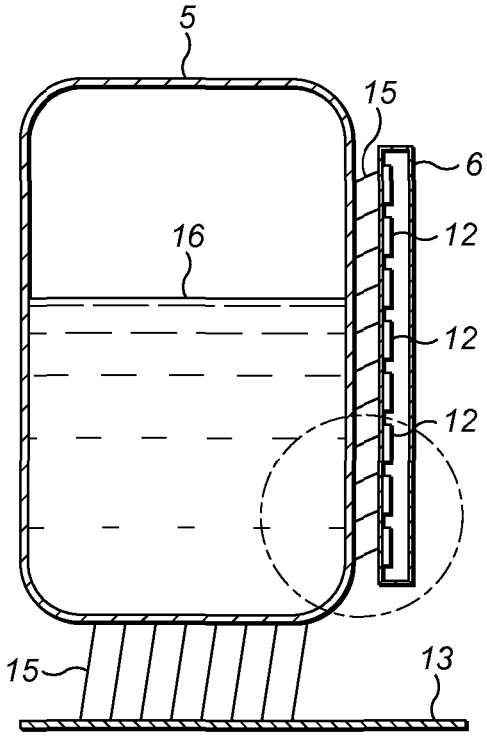
FIG. 2: shows a schematic view of a level measuring arrangement according to the invention.
Figure 3:
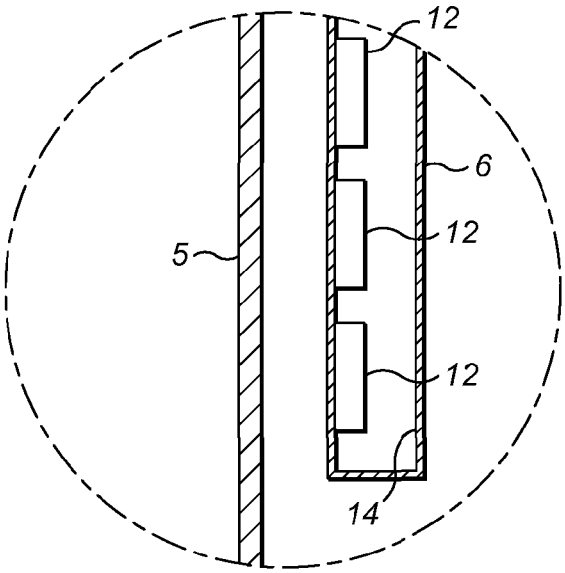
FIG. 3: shows a view, in larger scale, of that which is circled in FIG. 2.

As can best be seen in FIGS. 2 & 3, the carrier 6 provides a mount for a vertical array of capacitive sensor pads 12. It will be appreciated that the mounting of the carrier via the compliant mount 9 allows the carrier to assume a position in which all of the pads 12 are substantially equi-spaced from the wall 11 and thus, assuming the wall is of constant thickness, to the fluid within the module 5. The other physical component of the capacitive measuring system is provided by ground plate 13 positioned beneath the module 5.

Given the natural inclination of field lines from the fluid 16 to seek the closest earth, it is important to mount the ground plate 13 as close as possible to the container so that the system is less susceptible to noise due to stray capacitance. Hence it is convenient to position the ground plate 13 beneath the container.

In the form shown the sensor pads 12 are formed on a common face of a printed circuit board 14 that includes shielding areas of copper behind and adjacent to the pads 12 to suppress the formation of lateral and rearward field lines.

The field lines 15 extending from the sensor array are believed to follow a pattern similar to that shown in FIG. 2 i.e. the field lines extend from each pad 12 into the module 5, and between the fluid in the container and the ground plate 13.

A further important feature of the invention is that the sensors 12 are included in what is essentially a binary circuit, the output from the circuit indicating only one of two options, namely whether a particular sensor in the array is above ('dry') or below ('wet') the level of fluid within the module 5. As can be seen in FIG. 2, the level 16 of fluid within the module lies between the $5^{th}$ and $6^{th}$ pads, starting from the bottom up. The wet pads give an output of 1 whilst the dry pads give an output of 0.

Figure 4:
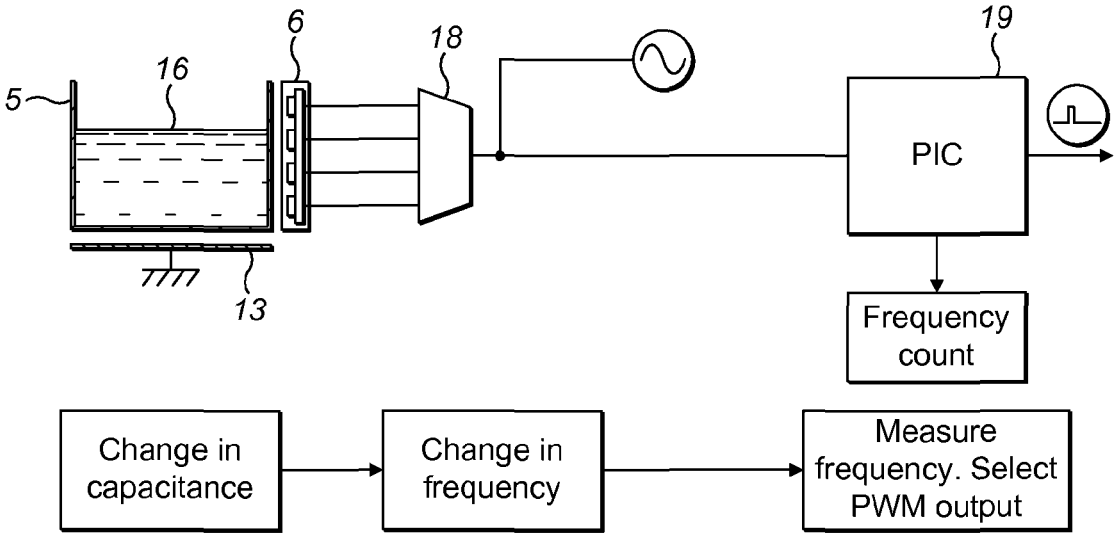
FIG. 4: shows a schematic of a signal processing circuit incorporated in a level measuring system according to the invention.

Turning to FIG. 4 an example of a sensing circuit embodying the sensors 12 is shown. This particular circuit has an array of four rather than eight vertically spaced sensor pads although it will be appreciated that the same principles apply regardless of the number of sensors in the array.

FIG. 4 shows an oscillation circuit which is configured so that the frequency of oscillation is defined by the circuit capacitance. Thus, by sequentially switching each of the sensor pads into the circuit, using multiplexer 18, a change of capacitance and thus frequency will arise when there is a change between wet and dry in two successive measurements. Providing the resulting change in frequency exceeds a threshold stored in the PIC 19, an output will be generated indicating the change.

By knowing which of the sensor pads 12 is currently switched into the circuit when the change of capacitance/frequency arises, a determination can be made of between which two sensors the fluid level 16 lies.

The method preferably includes sequentially switching each of the sensors 12 into the circuit starting from the bottom up. This ensures that the measurement starts with a known wet sensor and moves up until the circuit detects the first pad that measures lower than the threshold level. At this point the fluid level is identified. In this way, a globule of ink on the inner wall of the module 5 above the real ink level, or a meniscus or other surface wetting, will not give rise to a false level indication.

It will be appreciated that only three detection levels are required in order to establish High, OK, Replace Cartridge, and Low. However the additional sensor pads can allow these levels to be varied if desired, and enable further levels to be established for fault diagnosis. As shown the sensor pads are equi-spaced but could be spaced by different amounts if greater resolution were required over part of the height of the container.

A further feature of the circuit is that it has been designed to operate with a response time suitable for the rate at which fluid levels normally change within the printer. This response time has been nominally set at 15 seconds, this being the period required for the measuring system to respond to a step change in fluid level. This is fast enough to detect a real change in fluid level due to ink or make-up consumption but is slow enough to ignore any 'noise' signals caused, for example, by printer vibration or movement.

It will thus be appreciated that the present invention provides a robust yet relatively simple, non-contact, system for establishing where ink and or make-up levels lie between pre-defined limits. Because the system is not looking for absolute levels but is merely looking for when a level passes through defined limits, fluids having a wide range of electrical conductivities can be monitored using a single configuration of system as described.

The invention claimed is:

1. An inkjet printer comprising:

a fluids container;

a level measurement facility external to said container for determining fluid levels within said container, said level measurement facility includes a vertical array of discrete sensors adjacent to an exterior surface of said container and a sensing circuit into which each of said sensors may be sequentially switched to determine solely whether a sensor is above or below a particular fluid level in said container, wherein said sensing circuit is configured as a frequency oscillation circuit wherein the frequency of oscillation is defined by circuit capacitance and wherein a change of frequency above a pre-determined threshold between two successive measurements is interpreted as indicating a change from fluid to air between the levels of the sensors giving rise to said successive measurements; and an earth plate separate from, and arranged beneath, said container such that said earth plate is not electrically coupled to the fluid.

2. A printer as claimed in claim 1 wherein said level measurement facility further includes a carrier on which said array of sensors is mounted, said carrier being configured to ensure field lines from said sensors are directed into said fluids container.

3. A printer as claimed in claim 2 wherein said carrier has a compliant mount to enable said sensors to assume positions that are substantially equi-distant from an exterior wall of said fluids container.

4. A method of determining if a fluid is above or below defined levels in a fluids container for an inkjet printer, said method comprising the steps of:

arranging a substantially vertical array of sensors adjacent an exterior surface of said container;

sequentially switching individual sensors into a sensing circuit to determine solely whether the sensor is above or below a fluid level within said container;

configuring said sensing circuit as a frequency oscillation circuit wherein the frequency of oscillation is defined by circuit capacitance and wherein a change of frequency above a pre-determined threshold between two successive measurements is interpreted as indicating a change from fluid to air between the levels of the sensors giving rise to said successive measurements; and arranging an earth plate external to, and beneath, said container such that said earth plate is not electrically coupled to the fluid.

5. A method as claimed in claim 4 involving sequentially switching said sensors from the lowermost sensor upwardly.

6. A method as claimed in claim 4 comprising shielding said sensors to ensure field lines extending from all of said sensors are directed toward said container.

7. A method as claimed in claim 4 comprising mounting said sensors on a common carrier.

8. A method as claimed in claim 7 comprising mounting said carrier so that said sensors can assume positions which are substantially equi-spaced from said exterior surface of said container.

* * * * *